US010309146B1

(12) United States Patent
Rosende

(10) Patent No.: US 10,309,146 B1
(45) Date of Patent: Jun. 4, 2019

(54) SCREWLESS WINDOW FASTENING SYSTEM

(71) Applicant: Deco Flash, LLC, Tampa, FL (US)

(72) Inventor: John Rosende, Tampa, FL (US)

(73) Assignee: Deco Flash LLC, Tampa, FL (US)

( * ) Notice: Subject to any disclaimer, the term of this patent is extended or adjusted under 35 U.S.C. 154(b) by 0 days.

(21) Appl. No.: 15/864,013

(22) Filed: Jan. 8, 2018

(51) Int. Cl.
*E06B 1/36* (2006.01)

(52) U.S. Cl.
CPC ..... *E06B 1/36* (2013.01)

(58) Field of Classification Search
CPC ..... E06B 1/36
USPC ..... 52/213, 656.1, 204.5
See application file for complete search history.

(56) References Cited

U.S. PATENT DOCUMENTS 2,840,202 A 6/1958 Hehr
2,840,203 A 6/1958 Hehr
3,072,229 A * 1/1963 Pasche ..... E06B 3/26 49/401
3,975,881 A * 8/1976 Ninowski, Jr. ..... E06B 3/4618 52/775
4,328,644 A * 5/1982 Scott ..... E06B 3/302 49/501
4,525,966 A 7/1985 Litchfield
5,083,409 A 1/1992 Pliml
5,245,788 A 9/1993 Riegelman
5,355,651 A 10/1994 Correia
5,560,149 A 10/1996 Lafevre
5,622,017 A * 4/1997 Lynn ..... B29C 65/20 52/204.5
5,660,010 A * 8/1997 Sayers ..... E06B 1/30 49/DIG. 2
5,687,518 A * 11/1997 Endo ..... E06B 3/10 49/501
6,327,826 B1 * 12/2001 Mann ..... E06B 5/161 52/1
6,427,398 B1 * 8/2002 Levine ..... E06B 1/28 52/100
6,688,044 B2 * 2/2004 Farrar ..... B60J 1/2094 49/375
6,786,453 B2 9/2004 Jones
7,162,841 B2 1/2007 Kownacki
7,454,865 B2 11/2008 Kerscher
7,490,442 B1 2/2009 Jackson et al.
7,654,046 B2 2/2010 Ellingson
7,823,833 B2 11/2010 Wood
(Continued)

FOREIGN PATENT DOCUMENTS

WO 2009069080 8/2009

*Primary Examiner* — Paola Agudelo
(74) *Attorney, Agent, or Firm* — Maxey-Fisher, PLLC; Brittany J. Maxey-Fisher

(57) ABSTRACT

A screwless window fastening system has a frame having an exterior surface, an interior surface, and a peripheral wall extending between the exterior and interior surfaces. The peripheral wall has an inward facing surface forming a window opening for receiving a window assembly through the exterior surface. At least one window clip has a window frame receiving channel and is attachable to a window frame of a window with the window frame disposed in the window channel to form an assembly that is insertable into the window opening. And when the assembly is inserted into the window opening, the at least one window clip engages with the frame to prevent withdrawal of the assembly from the window opening.

7 Claims, 8 Drawing Sheets

(56) References Cited

U.S. PATENT DOCUMENTS

| | | | | |
|---|---|---|---|---|
| 7,958,682 | B2 | 6/2011 | Elzein | |
| 8,245,462 | B2 | 8/2012 | Miethe | |
| 8,353,138 | B2 * | 1/2013 | Sigmund | E06B 7/14 52/204.5 |
| 8,448,394 | B2 | 5/2013 | Miethe | |
| D736,956 | S * | 8/2015 | Chaney | D25/124 |
| 2002/0078640 | A1 | 6/2002 | Petta | |
| 2005/0072073 | A1 * | 4/2005 | Inelli | E06B 1/02 52/204.1 |
| 2005/0178079 | A1 * | 8/2005 | Hardman | E06B 1/02 52/208 |
| 2009/0193728 | A1 | 8/2009 | Bulter | |
| 2010/0251644 | A1 | 10/2010 | Quesada | |
| 2017/0051552 | A1 * | 2/2017 | Rosende | E06B 1/6053 |

* cited by examiner

SCREWLESS WINDOW FASTENING SYSTEM

FIELD OF THE INVENTION

The present invention relates generally to window installation and, more particularly, relating to a screwless window fastening system for installing and securing a window within a window opening in a wall.

BACKGROUND OF THE INVENTION

Prefabricated windows are conventionally installed in a window opening in a wall of building by using penetrating fasteners such as nails and screws that are nailed or screwed through the window frame and into the surrounding building structure that forms the window opening. While penetrating fasteners securely fasten the window in place, there are several problems with using penetrating fasteners.

A predominate problem with using penetrating fasteners to secure a window in place is that the fasteners create holes through the window frame and the surrounding building structure. And these holes provide an opportunity for undesirable water intrusion through the window frame and into the surrounding building structure. Accordingly, there is a need and desire for a new way to secure a window that overcomes this problem and other inherent problems with current window installation systems and methods.

SUMMARY OF THE INVENTION

In view of the foregoing problems with conventional window fastening systems and methods, embodiments of the present invention provide a screwless window fastening system for securing a window in place without using fasteners that penetrate the window frame or the surrounding building structure.

In general, in one aspect, a screwless window fastening system has a frame having an exterior surface, an interior surface, and a peripheral wall extending between the exterior and interior surfaces. The peripheral wall has an inward facing surface forming a window opening for receiving a window assembly through the exterior surface. At least one window clip has a window frame receiving channel and is attachable to a window frame of a window with the window frame disposed in the window channel to form an assembly that is insertable into the window opening. And when the assembly is inserted into the window opening, the at least one window clip engages with the frame to prevent withdrawal of the assembly from the window opening.

In general, in another aspect, the screwless window fastening system may have at least one fastening clip that is removably engagable with the at least one window clip and the interior surface of the window frame.

In general, in another aspect, that at least one fastening clip may have a first prong and a second prong. The first prong being removably receivable by a groove formed in the at least one window clip and the second prong being removably receivable by a groove formed through the interior surface of the window frame to attach the at least one fastening clip to the at least one window clip and the frame to further secure the assembly in the window opening.

There has thus been outlined, rather broadly, the more important features of the invention in order that the detailed description thereof that follows may be better understood and in order that the present contribution to the art may be better appreciated.

Numerous objects, features and advantages of the present invention will be clear to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

With reference to FIGS. 1-10 of the drawings, there is representatively shown a screwless window fastening system 10 that is constructed according to an embodiment of the present invention.

Figure 1:
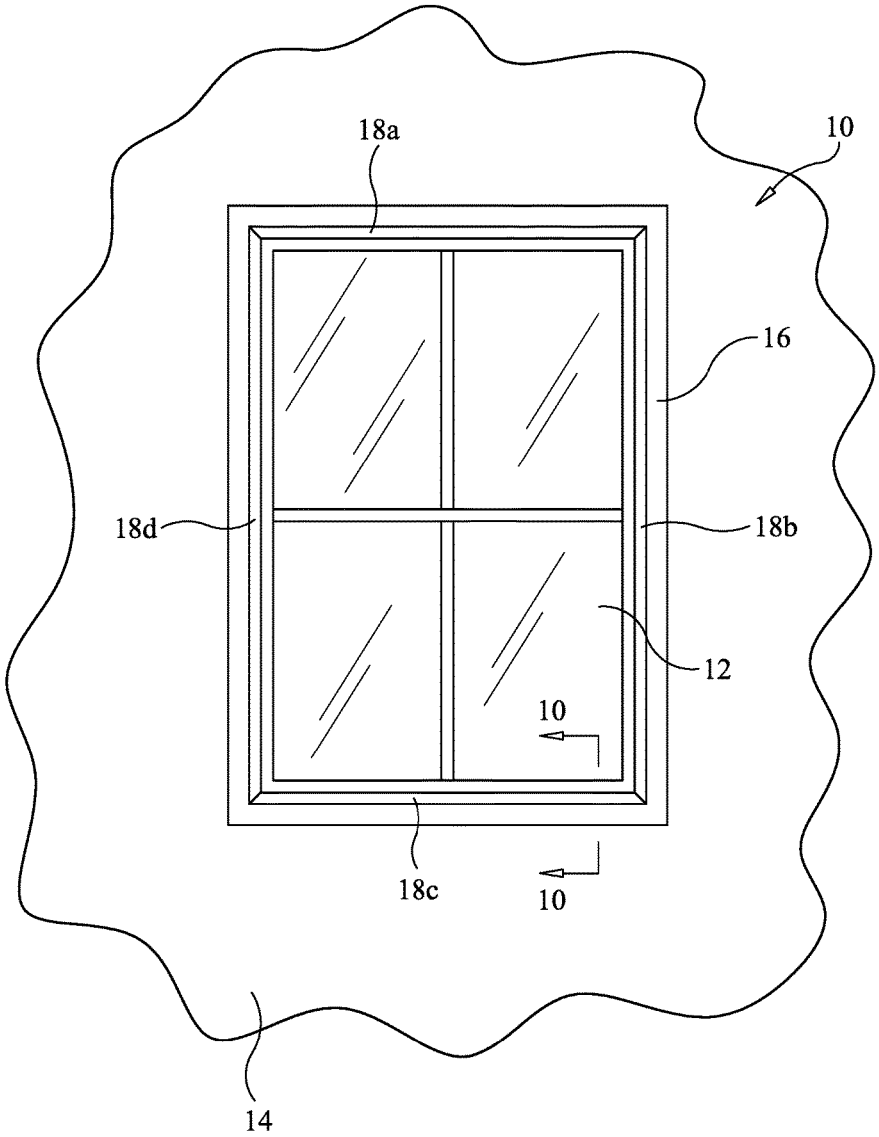
FIG. 1 is an exterior elevation view of a window installed and secured in a wall by a screwless window fastening system constructed in accordance with an embodiment of the invention.

In FIG. 1, there is shown an exterior view of a window 12 that is installed within wall 14 by the screwless window fastening system 10. In the depicted embodiment, the window fastening system 10 includes a frame 16 and a plurality of window clips 18*a*-18*d*. The frame 16 is disposed in a rough opening formed in the wall 14 and provides a window opening in which the window 12 is disposed and secured in place by the window clips 18*a*-18*d*, which are arranged around the window.

Figure 2:
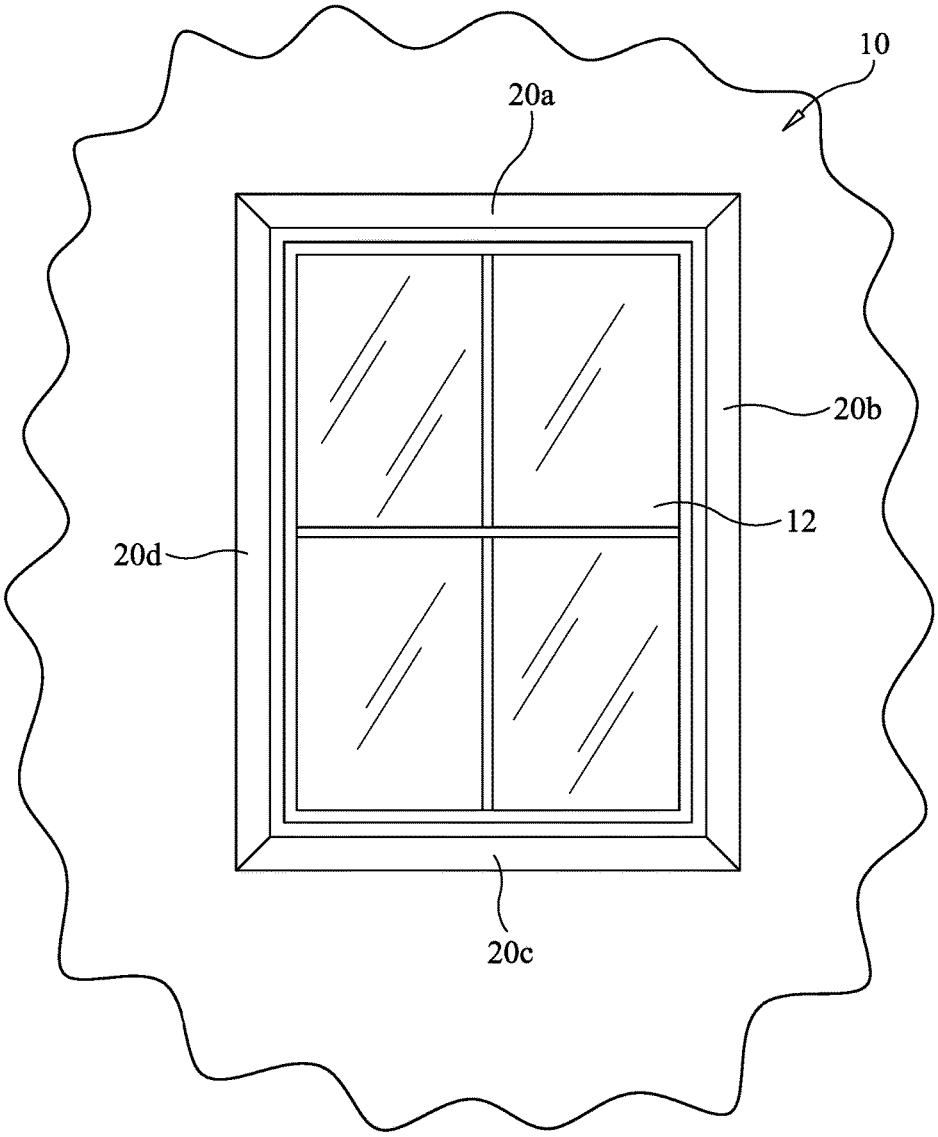
FIG. 2 is an interior elevation view of the window and screwless window fastening system of FIG. 1.

In FIG. 2, there is shown an interior view of window 12 that is installed within wall 14 by the screwless window fastening system 10. As shown, in this embodiment, the system 10 includes a plurality of fastener clips 20*a*-20*d* that are arranged around the window 12 and which secure to the frame 16 and window clips 18*a*-18*d*, which will be described in further detail below.

Figure 3:
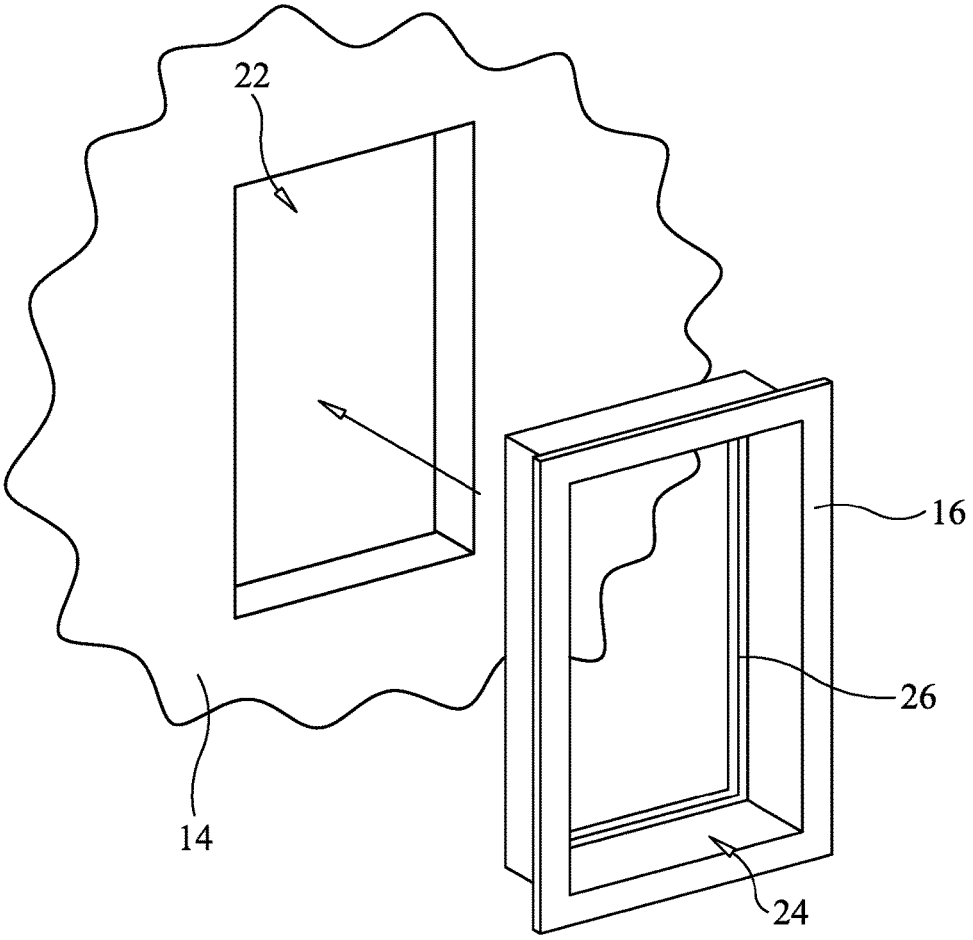
FIG. 3 is a perspective view of a frame of the screwless window fastening system shown being inserted into a rough opening of a wall.
Figure 5:
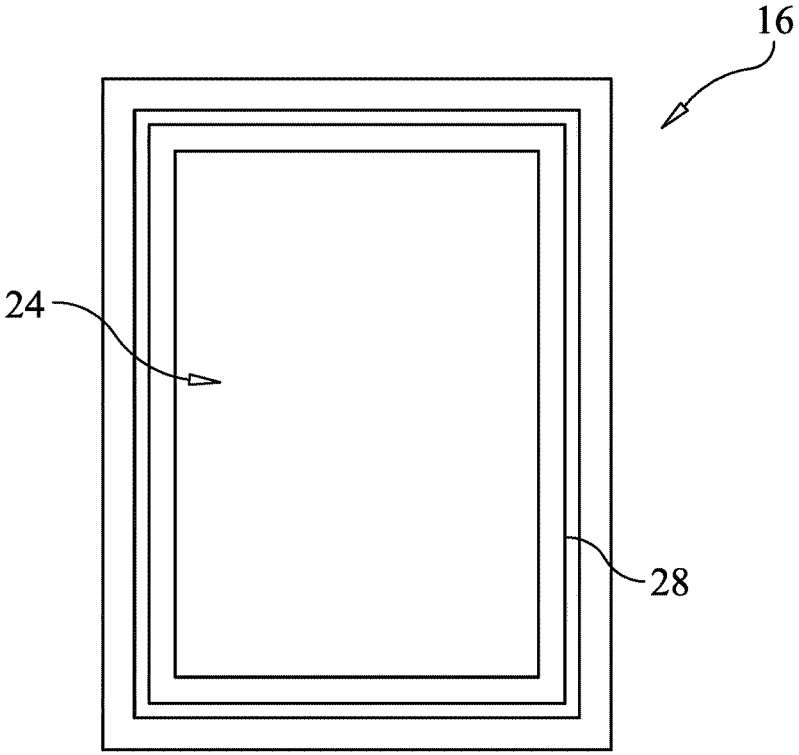
FIG. 5 is a back or interior elevation view of the frame of FIG. 4.
Figure 4:
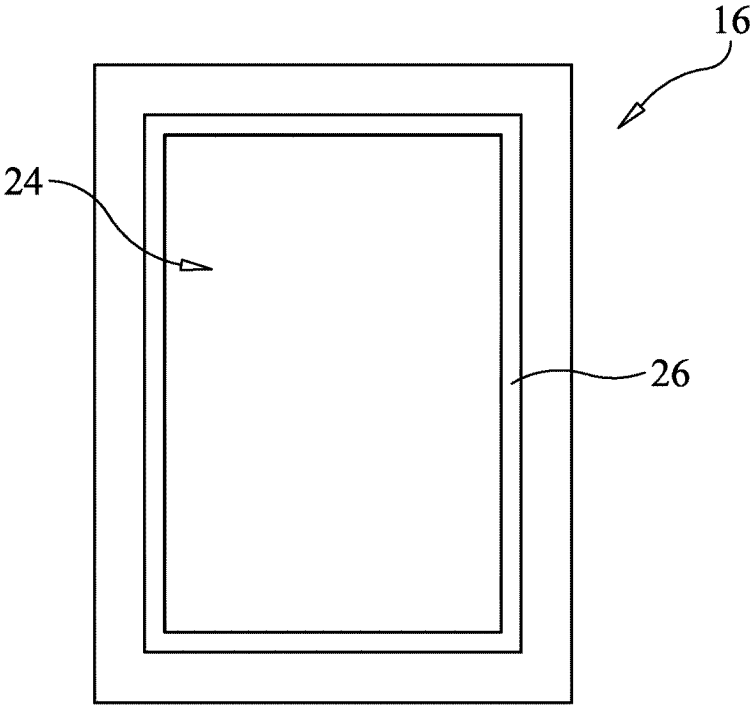
FIG. 4 is a front or exterior elevation view of the frame of FIG. 3.

In FIG. 3, there is shown a perspective, exterior view of the wall 14 having a rough opening 22 formed therein and the frame 16 being inserted into the rough opening. Frame 16, as depicted, includes a plurality of side walls that define a window opening 24. Frame 16 further includes a sill flange 26 that is disposed at the back or interior side of the frame and which is formed around the window opening and extends inwardly and perpendicular to the side walls of the frame. The frame 16 is further depicted in FIGS. 4 and 5, which show the front or exterior side and the interior side of the frame, respectively. As shown in FIG. 5, the frame 16 further includes a groove 28 that is formed through an interior side of the frame and that runs around the perimeter of the frame.

Figure 6:
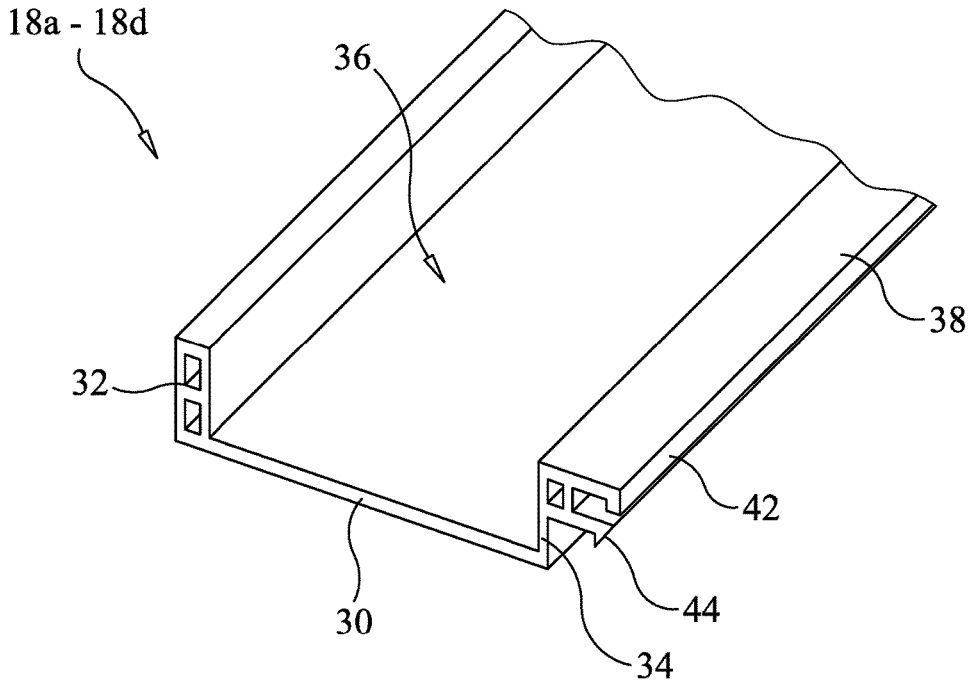
FIG. 6 is a fragmented, perspective view of a window clip of the screwless window fastening system.

Turning to FIG. 6, there is shown a fragmented, perspective view of window clip 18*a*, the remaining clips 18*b*-18*d* having the same construction. As depicted, window clip 18*a* is elongated and is of a generally C-channel shape having a central web 30, forward leg or flange 32 that extends perpendicularly along one edge of the web, and a rear leg of flange 34 that extends perpendicularly along the opposite edge of the web. The web and flanges 32 and 34 define a window frame reception channel 36. Clip 18*a* further includes a ledge 38 that extends along an outward side, relative to the channel 36. Ledge 38 includes a groove 40 the top edge of which includes a lip 42 and the bottom edge 44 of which has a prong-shape in cross section as depicted. Groove 40 opens in a direction that is perpendicular to flange 34.

Figure 7:
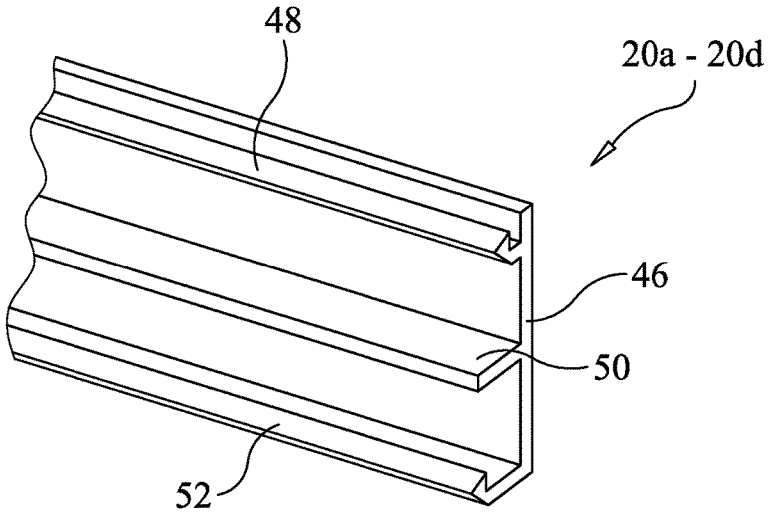
FIG. 7 is a fragmented, perspective view of a fastener clip of the screwless window fastening system.

In FIG. 7 there is shown a fragmented, perspective view of fastener clip 20*a*, the remaining clips 20*b*-20*d* having the same construction. As depicted, fastener clip 20*a* is elongated and includes web 46, an elongated prong 48 that runs along the length of the web 46, a brace flange 50 that runs along the length of web 46 and spaced from prong 48, and a second prong 52 that runs along the length of web 46 and spaced from flange 50. Prong 48, flange 50, and prong 52 are disposed on the same side of web 46.

Figure 8:
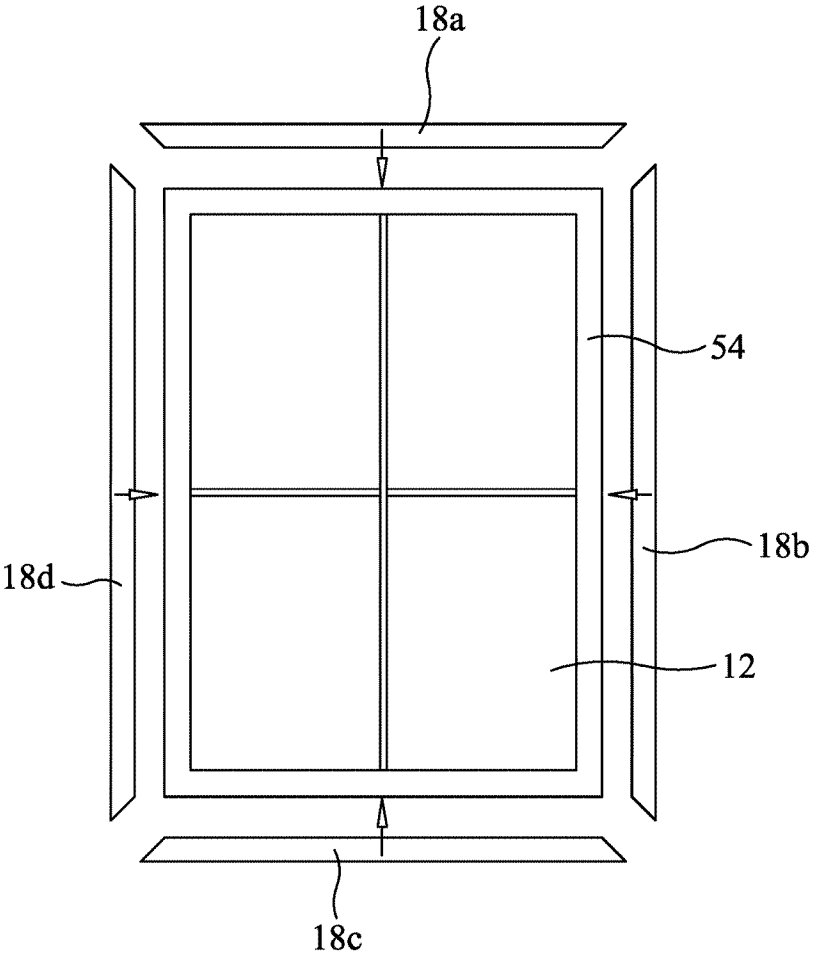
FIG. 8 is an elevation view of a window showing a plurality of window clips being installed on the window frame of the window.

With reference now to FIG. 8, there is shown the window 12 and window clips 18*a*-18*d* being installed onto the window frame 54 of the window. Particularly, each window clip 18*a*-18*d* are installed on a respective side of the window frame with that side of the window frame being disposed within the window channel 36 of the respective clip and with flange 32 dispose at the front or exterior side of the window frame and flange 34 disposed at the exterior side of the window frame. Clips 18*a*-18*d* may be secured to the window frame by double-sided tape, adhesive, caulking, or other suitable means that is disposed within the window channel 36.

Figure 9:
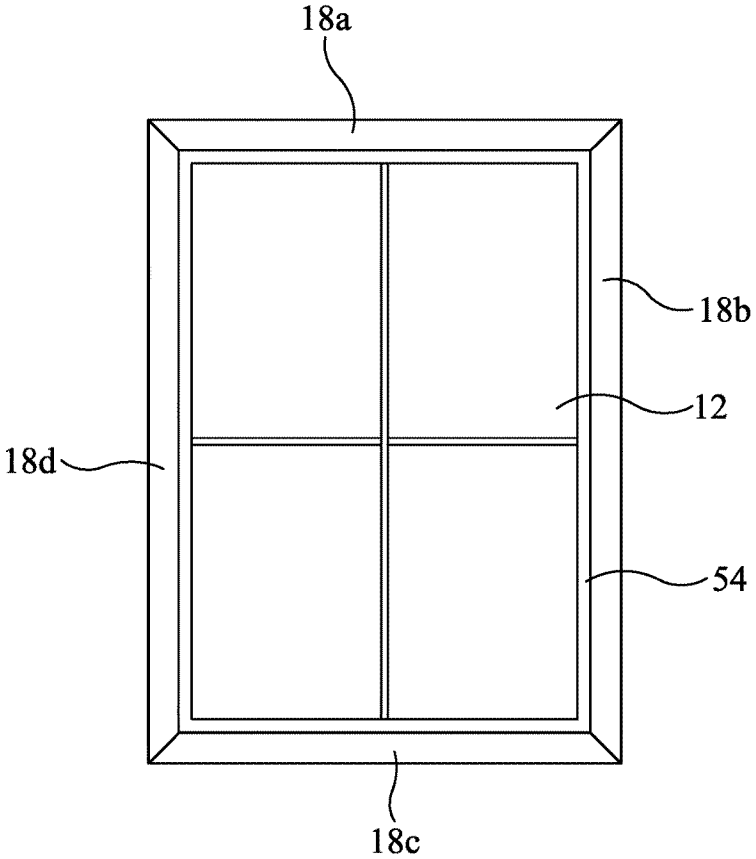
FIG. 9 is an elevation view of an assembly comprising the window and the window clips attached to the window.

In FIG. 9 there is shown window 12 with the window clips 18*a*-18*d* attached to and secured to the window frame 54 and forming an assembly 56 for insertion into the window opening 24 of frame 16 in a direction through the exterior side thereof and toward the interior side where the sill flange 26 is disposed.

Figure 10:
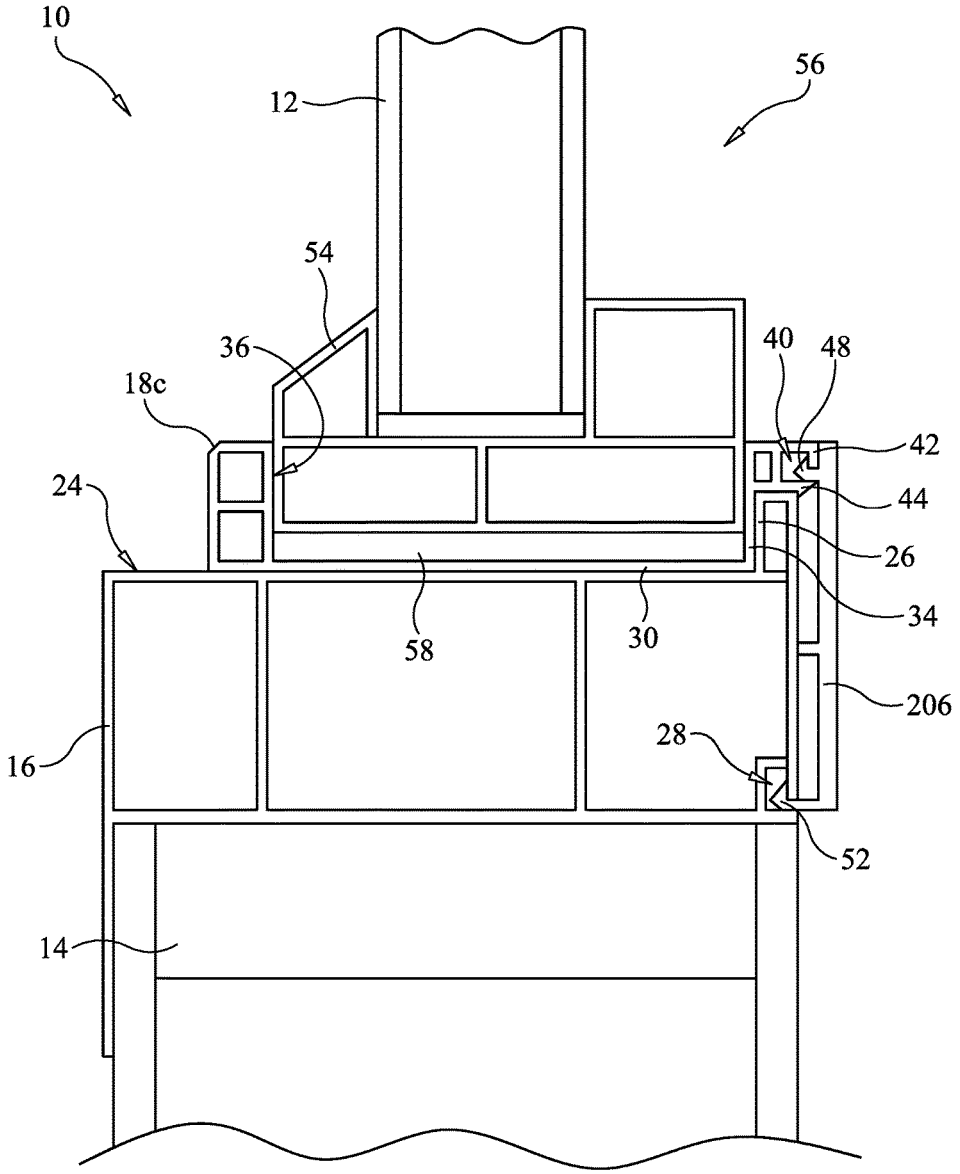
FIG. 10 is an enlarged, fragmented cross-sectional view along line 10-10 in FIG. 1.

In FIG. 10 there is shown an enlarged, fragmented cross-sectional view taken along line 10-10 in FIG. 1. As depicted, frame 16 is disposed within the rough opening of the wall 14 and assembly 56 has been inserted into and is disposed within window opening 24 of frame 16 with flange 34 of window clip 18*c* pressed against window sill flange 26. In this position, prong 44 of clip 18*c* is engaged with the sill flange 26 as shown to prevent assembly 56 from being withdrawn from the frame 16. Fastener clip 20*c* is engaged with window clip 18*c* by prong 48 being disposed or received within groove 40 and engaged with lip 42. Fastener clip 20*c* is also engaged with frame 16 by prong 52 being disposed or received within grove 28 of the frame 16. As further shown, double-sided foam tape 58 is located within the window channel 36 between the window frame 54 and web 30, thereby securing the window clip 18*c* to the window frame.

While not illustrated here, window clips 18*a*, 18*b*, and 18*d* are engaged with the frame in the same manner as clip 18*c*. And fastener clips 20*a*, 20*b*, and 20*d* are engaged with the frame 16 and window clips 18*a*, 18*b*, and 18*d* in the same manner as clip 20*c*.

Additionally, a sealant (not shown) may be used between the window clips 18*a*-18*d* and the frame 16 to weather proof the contact surfaces between the window clips and the frame.

To this end, with the screwless window fastening system 10, window 12 is installed and secured in place in wall 14 without screws or types of penetrating fasteners extending through the window frame 54 and into the surrounding wall structure that forms the rough opening 22.

Figure 11:
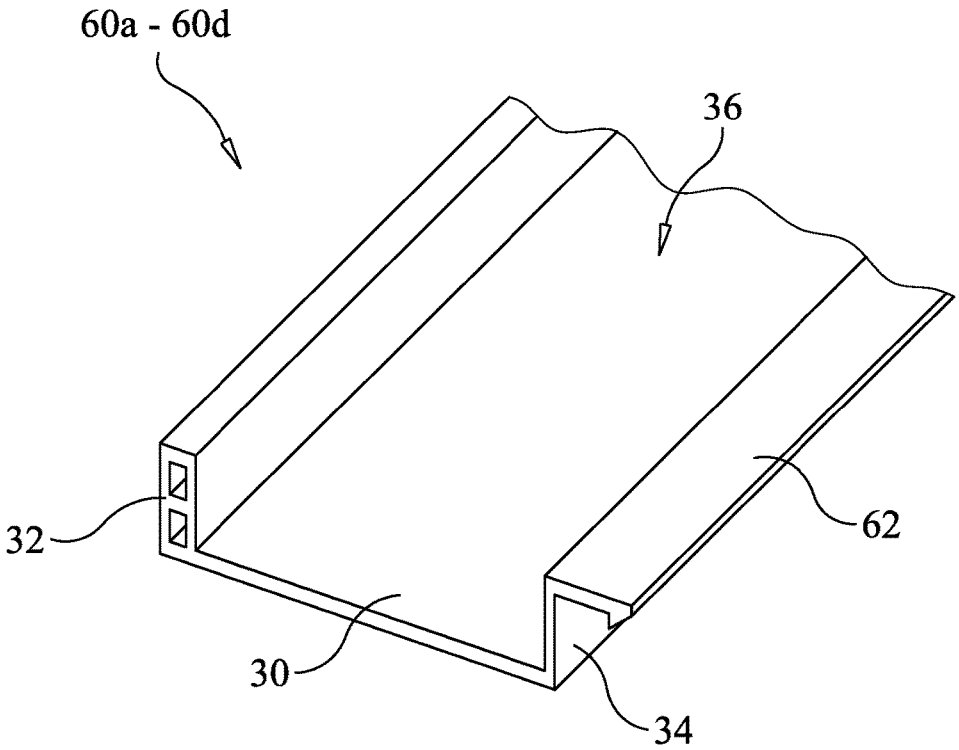
FIG. 11 is a fragmented, perspective view of a window clip according to an alternative embodiment of the screwless window fastening system.

Turning now to FIG. 11, in an alternative embodiment, window clips 18*a*-18*d* are replaced with window clips 60*a*-60*d* which do not include groove 40. Rather, window clips 60*a*-60*d* include a prong 62 that extends along and outwardly from flange 34 for engagement with window sill flange 26 in the same manner as prong 44 of clips 18*a*-18*d* engage with the window sill flange. Further, in this embodiment, fastener clips 20*a*-20*d* are not used.

Several embodiments of the present invention have been described. Nevertheless, it will be understood that various modifications may be made without departing from the spirit and scope of the invention. Accordingly, other embodiments are with the scope of the following claims.

What is claimed is:

1. A screwless window fastening system comprising;

a frame having an exterior surface, an interior surface, and a peripheral wall extending between said exterior and interior surfaces, said peripheral wall having an inward facing surface, said inward facing surface of said peripheral wall defining a window opening for receiving a window assembly through said exterior surface;

at least one window clip having a window frame receiving channel and being attachable to a window frame of a window with the window frame disposed in said window channel to form an assembly that is insertable into said window opening; and at least one fastening clip that is removably engagable with said at least one window clip and said interior surface of said window frame, wherein said at least one fastening clip has a first prong and a second prong, said first prong is removably receivable by a groove formed in said at least one window clip and said second prong is removably receivable by a groove formed through said interior surface of said window frame to attach said at least one fastening clip to said at least one window clip and said frame to further secure said assembly in said window opening;

wherein when said assembly is inserted into said window opening said at least one window clip engages with said frame to prevent withdrawal of said assembly from said window opening.

2. The screwless window fastening system of claim 1, wherein said assembly is insertable into said window opening only in a direction through said exterior surface.

3. A screwless window fastening system comprising:

a frame having an exterior surface, an interior surface, and peripheral wall extending between said exterior and interior surfaces, said peripheral wall having an inward facing surface, said inward facing surface of said peripheral wall defining a window opening for receiving a window assembly, said peripheral wall configured for positioning within an opening through a wall with said exterior surface adjacent the exterior surface of the wall and with said interior surface adjacent an interior surface of the wall;

said frame further having a sill flange extending around and projecting from said inward facing surface in a direction laterally inwardly therefrom;

at least one window clip having a window frame receiving channel and being removably engagable to said sill flange;

wherein said at least one window clip is attachable to a window frame of a window with the window frame disposed in said window channel to form an assembly is insertable into said window opening through said exterior surface of said frame to engage said at least one window clip with said sill flange to prevent withdrawal of said assembly from said window opening; and at least one fastening clip that is removably engagable with said at least one window clip and said interior surface of said window frame, wherein said at least one fastening clip has a first prong and a second prong, said first prong is removably receivable by a groove formed in said at least one window clip and said second prong is removably receivable by a groove formed through said interior surface of frame to attach said at least one fastening clip to said at least one window clip and said frame to further secure said assembly in said window opening.

4. The screwless window fastening system of claim 3, wherein said groove formed through said interior surface of said frame extends around the perimeter of said interior surface.

5. The screwless window fastening system of claim 3, wherein said at least one window clip has a prong that extends along a length of said at least one window clip and that is removably engageable with said sill flange.

6. The screwless window fastening system of claim 3, wherein said sill flange is disposed at said interior surface of said frame.

7. The screwless window fastening system of claim 3, wherein said sill flange extends continuously around said inward facing surface.

* * * * *